US006622992B2

(12) United States Patent
Woody

(10) Patent No.: US 6,622,992 B2
(45) Date of Patent: Sep. 23, 2003

(54) CARBURETOR WITH FUEL ENRICHMENT

(75) Inventor: John C. Woody, Caro, MI (US)

(73) Assignee: Walbro Corporation, Cass City, MI (US)

( * ) Notice: Subject to any disclaimer, the term of this patent is extended or adjusted under 35 U.S.C. 154(b) by 0 days.

(21) Appl. No.: 10/094,825

(22) Filed: Mar. 11, 2002

(65) Prior Publication Data

US 2002/0135082 A1 Sep. 26, 2002

Related U.S. Application Data

(63) Continuation-in-part of application No. 09/815,406, filed on Mar. 22, 2001, now Pat. No. 6,523,809.

(51) Int. Cl.[7] ..... F02M 17/04
(52) U.S. Cl. ..... 261/35; 261/DIG. 68
(58) Field of Search ..... 261/35, 69.1, 69.2, 261/DIG. 8, DIG. 68

(56) References Cited

U.S. PATENT DOCUMENTS 3,104,617 A * 9/1963 Barr ..... 417/479
3,201,096 A * 8/1965 Barr ..... 261/41.5
3,321,192 A * 5/1967 Phillips ..... 261/35
3,738,623 A * 6/1973 Tuckey ..... 261/35
4,735,751 A * 4/1988 Guntly ..... 261/35
4,770,822 A * 9/1988 Sejimo ..... 261/35
4,814,114 A * 3/1989 Charmley ..... 261/35
4,903,655 A * 2/1990 Vonderau et al. ..... 123/198 C
4,944,272 A * 7/1990 Carlsson et al. ..... 123/438
5,002,705 A * 3/1991 Kohler ..... 261/35
5,133,905 A * 7/1992 Woody et al. ..... 261/35
5,241,931 A * 9/1993 Radel ..... 123/179.14
5,262,092 A * 11/1993 Reeder et al. ..... 261/35
5,394,840 A * 3/1995 Phelps ..... 123/73 C
5,545,357 A * 8/1996 Radel et al. ..... 261/35
5,720,906 A * 2/1998 Yamanaka et al. ... 261/DIG. 68
5,743,240 A * 4/1998 Zerrer et al. ..... 261/DIG. 68
5,891,369 A * 4/1999 Tuggle et al. ..... 261/DIG. 8
6,135,429 A * 10/2000 Woody ..... 261/35
6,523,809 B2 * 2/2003 Woody ..... 261/35

* cited by examiner

*Primary Examiner*—Richard L. Chiesa
(74) *Attorney, Agent, or Firm*—Reising, Ethington, Barnes, Kisselle, P.C.

(57) ABSTRACT

A carburetor having a first valve to control the application of pressure pulses to a fuel metering assembly of the carburetor through a first flow path and a second valve which controls at least a second flow path to provide an enriched fuel and air mixture to the engine to facilitate starting the engine and warming it up. The pressure pulses are preferably applied to a fuel metering diaphragm to actuate the diaphragm and cause a richer than normal fuel and air mixture to be delivered to the engine. Desirably, a maximum enrichment of the fuel and air mixture is obtained when at least one valve is open to facilitate starting the engine, and a lesser enrichment of the mixture may be obtained by closing a valve to facilitate warming the engine up after it is initially started.

33 Claims, 7 Drawing Sheets

CARBURETOR WITH FUEL ENRICHMENT

REFERENCE TO CO-PENDING APPLICATION

This application is a continuation-in-part of application Ser. No. 09/815,406, filed Mar. 22, 2001, and now U.S. Pat. No. 6,523,509.

FIELD OF THE INVENTION

This invention relates generally to carburetors and more particularly to carburetors for providing an enriched fuel and air mixture during starting and warming up of an engine.

BACKGROUND OF THE INVENTION

Some current diaphragm type carburetors utilize engine crankcase pressure pulses applied to the so-called dry side of a carburetor fuel control diaphragm to control or enrich the carburetor fuel and air mixture delivered to an engine during starting and warming up of the engine. Application of engine crankcase pressure pulses in carburetors, as disclosed in U.S. Pat. No. 4,814,114, is controlled by a manually operated, three-position valve. The valve has a fully closed position, a fully open position and an intermediate position between the fully closed and fully open positions.

To start an engine having this type of carburetor, the air is purged from the carburetor, such as by manually depressing an air purge bulb, the throttle valve is moved to its starting position and a three position valve is moved to its fully open position permitting engine crankcase pressure pulses to act on the fuel control diaphragm. The operator then tries to manually start the engine such as by pulling an engine starter rope or cord until engine combustion is initiated but not normally sustained and the engine stalls or dies rich. The valve is now manually moved to its intermediate position decreasing application of engine crankcase pressure pulses to the fuel control diaphragm. The operator then tries to restart the engine manually until the engine is started and operation of the engine is sustained. After a short period of time sufficient to allow the engine to warm up, the valve is manually turned to its fully closed position preventing the application of engine crankcase pressure pulses to the fuel control diaphragm.

Starting an engine having a carburetor with this manual three position choke valve can be difficult for unskilled operators who are unfamiliar with the multi-step engine starting process required with this type of carburetor. Further, the starting procedure has to be modified under different temperature conditions and the operator must have the knowledge and skill to employ the necessary modified starting procedure.

SUMMARY OF THE INVENTION

A carburetor having at least one path with a valve for application of pressure pulses to a fuel metering assembly of the carburetor and another valve, wherein the valves are actuated to provide an enriched fuel and air mixture to the engine to facilitate starting the engine and warming it up. Preferably, the pressure pulses are obtained from a crankcase chamber of the engine. A first valve in one path is preferably actuated by a diaphragm controlled automatically by a pressure signal from a carburetor fuel pump so that at low fuel pressure, such as during manual pulling of the engine starter rope, the first valve is open and at higher fuel pump pressure, such as when the engine is initially started and thereafter during engine operation, the first valve is closed. A second valve may be manually actuated to a position to further enrich the fuel to air mixture to facilitate starting and warming-up of the engine and then returned to a normal operating position after the engine is warmed-up. Preferably, the second valve is actuated to the normal operating position with manual opening of a throttle valve of the carburetor.

Desirably, with both valves oriented in a start position, maximum fuel enrichment is obtained and with only one of the valves oriented in a start position a lesser fuel enrichment is obtained. Accordingly both valves are preferably oriented in a start position to facilitate starting the engine with a maximum enrichment of the fuel and air mixture during cranking, and after starting, one of the valves is preferably closed to a normal operating position to reduce the enrichment while the engine warms up. Thereafter, the valve remaining in its start position is moved to its normal operating position so that the fuel metering assembly operates in its normal fashion to provide the desired fuel and air mixture to the engine during its normal operation.

Objects, features and advantages of this invention include providing a carburetor which provides an enriched fuel and air mixture to an engine to facilitate starting the engine, provides an enriched fuel and air mixture to facilitate warming up the engine, enables varying fuel enrichment at starting and warming up of the engine, greatly facilitates starting the engine, eliminates the need for a three position butterfly-type choke valve, provides a reduced enrichment during warming up of the engine to eliminate stalling, provides a quick and automatic switch from maximum enrichment to a lesser enrichment to prevent stalling of the engine after initial cranking and starting of the engine, is of relatively simple design and economical manufacture and assembly and in service has a long useful life.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Figure 1:
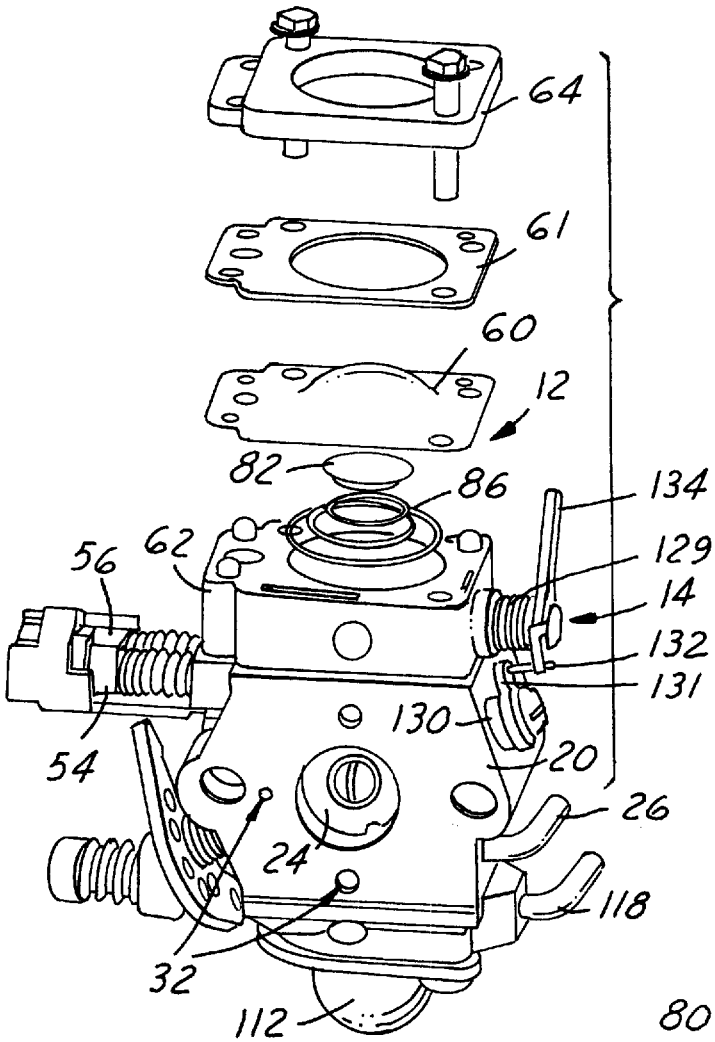
FIG. 1 is a partially exploded perspective view of a carburetor having two fuel enrichment valves in accordance with the present invention.
Figure 2:
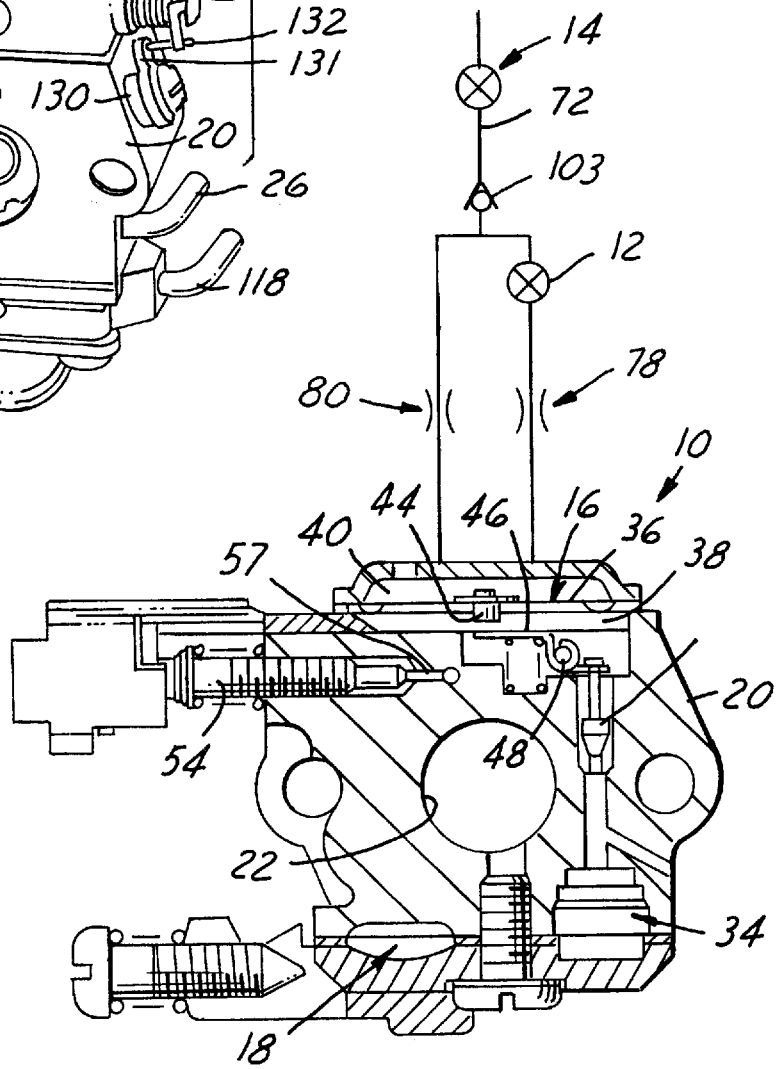
FIG. 2 is a semi-diagrammatic cross sectional view of the carburetor of FIG. 1.

Referring in more detail to the drawings, FIGS. 1 and 2 illustrate a carburetor 10 having a first enrichment valve 12 and a second enrichment valve 14 which control the application of pressure pulses to a fuel metering assembly 16 of the carburetor 10 to provide an enriched fuel and air mixture from the carburetor 10 to an engine to facilitate starting and warming up the engine. The first enrichment valve 12 is automatically controlled in response to pressure in a fuel pump assembly 18 of the carburetor 10 such that opening the valve 12 to provide the enriched fuel and air mixture to the engine and closing the valve 12 to prevent enrichment of the fuel and air mixture is controlled without operator intervention to greatly facilitate starting the engine and thereafter, normal operation of the engine. The second enrichment valve 14 may be manually set to its first or open position by the operator to provide an initial enrichment to facilitate starting and warming up the engine and may be either manually or automatically returned to its second or closed position to essentially prevent enrichment of the fuel and air mixture. Preferably, the pressure pulses are obtained from a crankcase chamber of the engine. The carburetor 10 as shown is ideally adapted for use with small two stroke engines, such as are used with hand held chain saws and lawn and gardening equipment, such as leaf blowers, weed trimmers and the like.

Figure 3:
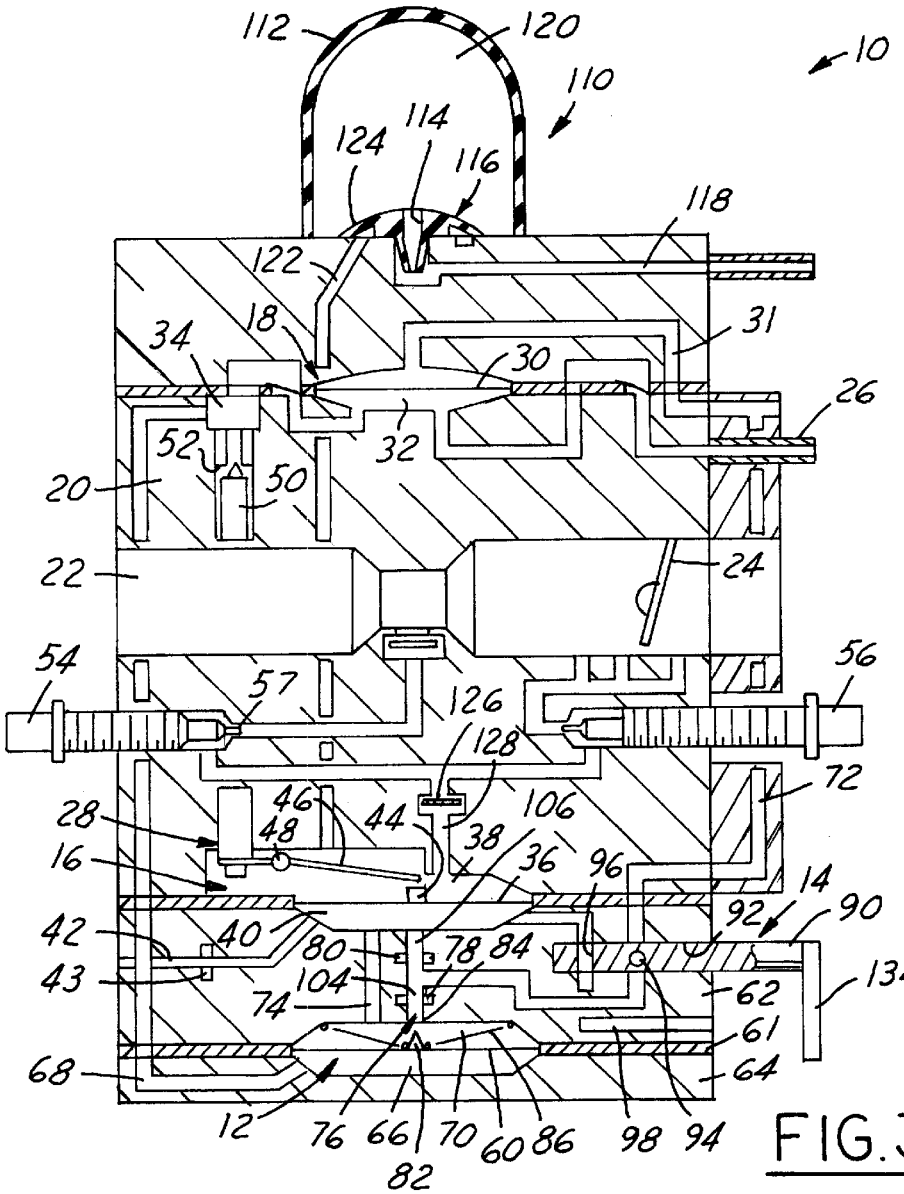
FIG. 3 is a semi-schematic cross sectional view of the carburetor.

As best shown in FIGS. 1–3, the carburetor 10 has a main body 20 with a mixing passage 22 in which a throttle valve 24 is mounted to control the airflow through the mixing passage 22. A fuel pump 18 in the body 20 receives fuel from a fuel inlet 26 and delivers fuel to the fuel metering assembly 16 through an inlet valve assembly 28 in response to crankcase pressure pulses applied to a fuel pump diaphragm 30 through a pressure pulse passage 31 which communicates with the engine crankcase. The pressure pulses create a pressure differential across the fuel pump diaphragm 30 which displaces the diaphragm 30 to draw fuel into a fuel pump chamber 32 and to discharge fuel from the fuel pump chamber 32 to an outlet 34 of the pump.

From the fuel pump outlet 34, fuel is delivered to the fuel metering assembly 16 through the inlet valve assembly 28 which is actuated by a fuel metering diaphragm 36. The fuel-metering diaphragm 36 defines a fuel-metering chamber 38 on one side and an air chamber 40 on its other side. Preferably, the air chamber 40 communicates with the atmosphere through a vent passage 42 having a restriction such as a vent valve 43 or a small flow area to limit fluid flow therethrough. The fuel metering diaphragm 36 is responsive to a differential pressure across it to actuate the inlet valve assembly 28 which controls the delivery of fuel from the fuel pump 18 to the fuel metering chamber 38. The fuel metering assembly 16 has a head 44 carried by the fuel metering diaphragm 36 and engageable with a lever 46 which rotates about a pivot pin 48 to move a valve body 50 relative to a valve seat 52 to control the flow of fuel through the valve seat 52 and into the fuel metering chamber 38 as disclosed generally in U.S. Pat. No. 5,262,092, the disclosure of which is incorporated herein by reference. The quantity of fuel delivered from the fuel metering chamber 38 to the mixing passage 22 is controlled by the air flow through the mixing passage 22 and by one or more needle valves 54,56 received in threaded bores in the carburetor body 20 and rotatably adjustable to control the flow area between each needle valve tip 57 and its associated valve seat.

According to the present invention, a pressure pulse control diaphragm 60 and a gasket 61 is mounted between a pair of plates 62,64 preferably carried by and attached to the carburetor body 20. The control diaphragm 60 defines a first chamber 66 on one side in communication with the fuel pump 18 through a passage 68 to communicate the pressure at the fuel pump outlet 34 with the control diaphragm 60. A second chamber 70 is defined on the opposite side of the control diaphragm 60 and is in communication with a crankcase chamber of the engine through a pressure pulse passage 72 leading to passage 31 and with the air chamber 40 through an unrestricted passage 74 and a restricted passage 76. The restricted passage 76 preferably has two restriction 78 and 80 with one restriction on each side of the juncture between the pressure pulse passage 72 and the restricted passage 76. The restrictions 78,80 may be integral with plate 62 or may be inserts carried by the plate. However they are formed, the restrictions 78,80 limit the fluid flow therethrough to control the magnitude of the pressure pulses communicated through the restricted passage 76. The restrictions 78,80 may be of different sizes or of the same size, and may have larger or smaller flow areas than the vent passage 42 and its restriction 43, as desired for a particular application.

The first enrichment valve 12 is preferably carried by the control diaphragm 60 and has a valve head 82 engageable with a valve seat 84 surrounding the restricted passage 76 to close the restricted passage 76 and thereby prevent the application of engine crankcase pressure pulses to the air chamber 40 through the second chamber 70 and the unrestricted passage 74 by closing the first enrichment valve 12. Preferably, the control diaphragm 60 is biased by a spring 86 to move the first enrichment valve 12 to its first or open position with its valve head 82 spaced from the valve seat 84 and permitting communication between the air chamber 40 and the engine crankcase through the second chamber 70 and both associated passages 74,76.

The second enrichment valve 14 is preferably defined in part by a shaft 90 which extends into a bore 92 in the plate 62 and which has two slots or holes 94,96 therethrough. A first hole 94 is rotated into and out of alignment with the pressure pulse passage 72 to control the application of crankcase pressure pulses to the control diaphragm 60 and fuel metering diaphragm 36. The second hole 96 defines in part a vent valve preferably actuated by and integral with the shaft 90 and is selectively communicated with a second vent passage 98 which permits a greater total flow rate than the first vent passage 42 to selectively communicate the air chamber 40 with the atmosphere through the second vent passage 98. The axes of the first and second holes 94,96 are preferably offset and may be perpendicular to each other so that when one of the holes is aligned with its corresponding passage, the other is generally transverse to its passage to close it. In this manner the application of engine crankcase pressure pulses to the air chamber 40 and the venting of the air chamber 40 to the atmosphere can be controlled.

Accordingly, two paths 100,102 are provided to communicate the pressure pulse passage 72 with the air chamber 40. A first path 100 comprises the pressure pulse passage 72, a first portion 104 of the restricted passage 76 leading to the second chamber 70, the second chamber 70, itself, and the unrestricted passage 74. The second path 102 comprises the pressure pulse passage 72 and a second portion 106 of the restricted passage 76 leading directly to the air chamber 40. Application of the pressure pulses to the air chamber 40 through both paths 100 and 102, provides maximum actuation of the fuel metering diaphragm 36 and hence, maximum enrichment of the fuel and air mixture delivered to the engine. Application of the pressure pulses through only one of the paths 100 or 102 provides a lesser than maximum enrichment of the fuel and air mixture. A check valve 103 may be provided in one or both of the flow paths 100,102 to permit only the positive pressure portion of the crankcase pressure pulses to flow through the paths 100,102 thereby increasing the intensity of the signal.

To facilitate starting the engine, a purge and primer assembly 110 as shown in FIG. 3 is preferably activated to purge air or fuel vapor from the carburetor 10 and prime the relevant passages and chambers with liquid fuel. To do this, a bulb 112 is manually depressed forcing fluid in the bulb 112 through a central check valve portion 114 of a combination check valve 116 and through a passage 118 to the fuel tank. As the bulb 112 expands to its undepressed position, a decrease in pressure is created in the expanding chamber 120 of the bulb 112 which draws fluid from the fuel metering chamber 38 through a passage 122 and a second check valve portion 124 of the combination valve 116 into the chamber 120 of the purge bulb 112. Subsequent depression of the bulb 112 will force any fuel and air in the bulb chamber 120 through the valve 116 and to the fuel tank with the subsequent expanding of the bulb 112 again drawing fluid from the metering chamber 38 into the bulb chamber 120. This cycle is repeated as needed to purge the carburetor 10 of air and fuel vapor and prime the relevant passages and chambers with liquid fuel. A check valve 126 at the metering chamber outlet 128 prevents the purge and primer assembly 110 from drawing air into the metering chamber 38 from the mixing passage 22.

Figure 4:
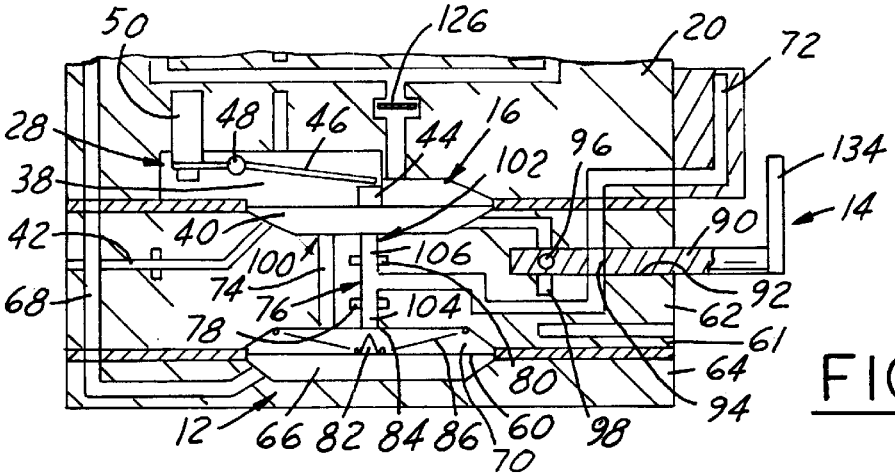
FIG. 4 is a fragmentary sectional view as in FIG. 3 illustrating both enrichment valves in their open position.

After air and fuel vapor are purged from the carburetor and it is primed with liquid fuel, the second enrichment valve 14 may be set to its first position as shown in FIG. 4, wherein the crankcase pressure pulse passage 72 is opened and the second vent passage 98 is closed. Preferably, setting the second enrichment valve 14 also moves the throttle valve 24 to a starting position between its idle and wide open positions. The first enrichment valve 12 is in its open position communicating the crankcase pressure pulse passage 72 with the air chamber 40 of the fuel metering assembly. When initially cranking the engine for starting, there is relatively little pressure generated by the carburetor fuel pump 18 and thus, there is little or no pressure within the first chamber 66 acting on the control diaphragm 60. The spring 86 biasing the control diaphragm 60 maintains the first enrichment valve 12 in its open position such that pressure pulses from the engine crankcase are communicated to the air chamber 40 through the first path 100. Pressure pulses from the crankcase also communicate with the air chamber through the second path 102 providing an increased pressure pulse signal to the fuel-metering diaphragm 36. The pressure pulses in the air chamber 40 cause the fuel metering diaphragm 36 to fluctuate and provide an increased fuel flow into the fuel metering chamber 38 and subsequently into the mixing passage 22 to provide an enriched fuel and air mixture to the engine to facilitate starting the engine. With both the first enrichment valve 12 and second enrichment valve 14 open, pressure pulses are communicated with the air chamber 40 through both paths 100 and 102 and a maximum enrichment is obtained of the fuel and air mixture delivered to the engine to facilitate starting the engine.

Figure 5:
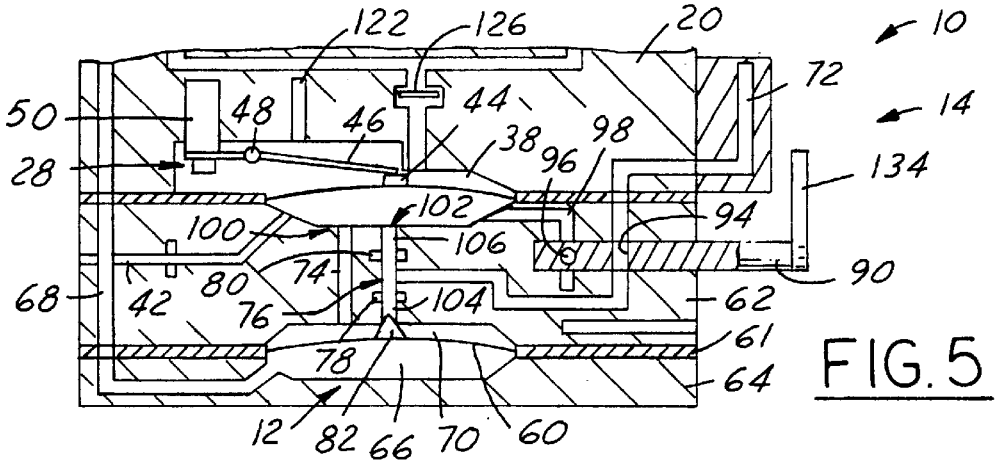
FIG. 5 is a fragmentary sectional view illustrating one of the enrichment valves open and the other closed.

As shown in FIG. 5, after the engine is started, the pressure generated by the carburetor fuel pump 18 increases and is communicated to the first chamber 66 and acts on the control diaphragm 60 tending to displace it and thereby move the first enrichment valve 12 to its closed position preventing the application of crankcase pressure pulses from the second chamber 70 to the air chamber 40. In other words, the first path 100 is closed. Engine crankcase pressure pulses are still applied to the fuel-metering diaphragm 36 through the second path 102. However, with the first enrichment valve 12 closed, the magnitude of the pressure pulses applied to the fuel metering diaphragm 36 are diminished to reduce the enrichment of the fuel and air mixture delivered to the engine after the engine is started. While the enrichment of the fuel and air mixture is diminished, a still somewhat enriched fuel and air mixture is delivered to the engine after it is started to facilitate warming up the engine.

Figure 6:
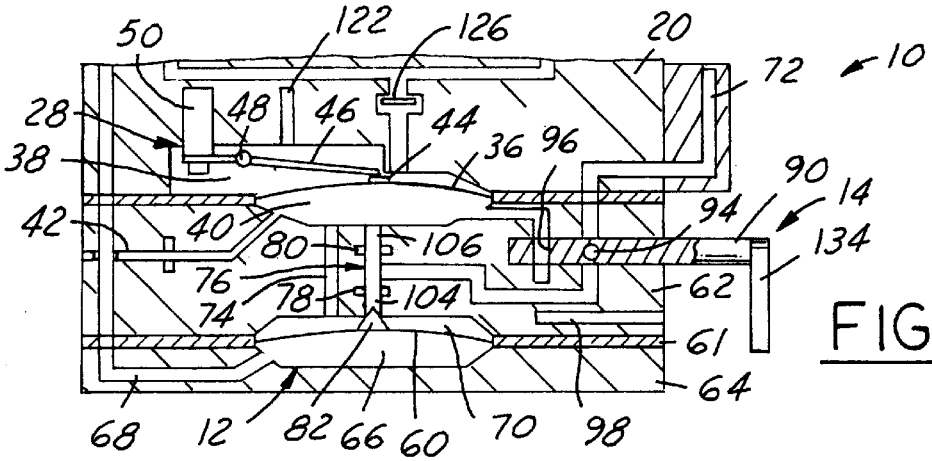
FIG. 6 is a fragmentary sectional view illustrating both enrichment valves in their closed positions.

As shown in FIG. 6, after the engine is sufficiently warmed the second enrichment valve 14 may be moved to its second position closing the crankcase pressure passage 72 and opening the unrestricted second vent passage 98 to vent the air chamber 40 and all passages connected thereto with the atmosphere. This terminates the application of crankcase pressure pulses to the fuel-metering diaphragm 36 so that the fuel metering assembly can function in its normal manner providing a desired fuel and air mixture, without enrichment, to the warmed-up operating engine. Desirably, the second enrichment valve 14 is yieldably biased by a spring 129 (FIG. 1) and linked to the throttle valve 24 of the carburetor 10 such that upon actuation of the throttle valve 24, from its starting position towards it wide open throttle position, the spring 129 returns the second enrichment valve 14 to its second position. With this arrangement, the operator need not worry about disengaging or moving the second enrichment valve 14 to its second position. As shown in FIG. 1, a protruding portion of a shaft 130 of the throttle valve 24 carries an actuator arm 131 and pin 132 which is engaged and displaced by a lever 134 of the second enrichment valve 14 to move the throttle valve 24 to its starting position when the second enrichment valve 14 is moved from its second position to its first position before starting the engine.

Accordingly, to start an engine having the carburetor 10 of the present invention the operator will activate the purge and primer assembly 110, set the second enrichment valve 14 to its first position and thereafter start the engine, such as by pulling a starter rope. With both enrichment valves 12,14 open a maximum enrichment of the fuel and air mixture is obtained to facilitate starting the engine with a minimum number of pulls of the engine starter rope. Upon starting of the engine, the increased pressure of the carburetor fuel pump 18 will close the first enrichment valve 12 to reduce the enrichment of the fuel and air mixture and thereby prevent the engine from dying rich. The operation and construction of the first enrichment valve is disclosed in U.S. Pat. No. 6,135,429, the disclosure of which is incorporated herein by reference in its entirety. After the engine warms up, actuation of the throttle valve 24 will permit the second enrichment valve 14 to close or in other words, move to its second position to close the crankcase pressure pulse passage 72 and open the second vent passage 98. Thus, a simplified starting and warming up procedure for the engine is obtained with the carburetor 10 of this invention.

Additionally, providing the two crankcase pressure pulse paths 100,102 to the air chamber 40 and the two valves 12,14 controlling flow through the paths 100,102 prevents failure of the carburetor 10 and engine when a pressure in the fuel system closes the first enrichment valve 12 prior to starting the engine. This may happen, for example, after a hot engine runs out of fuel, is then re-filled with cool liquid fuel and is permitted to rest for a sufficient time such that heat transferred from the hot engine and ambient air (such as on a hot summer day) heats the fuel in the tank and increases the fuel vapor pressure. This increased fuel pressure acts on the control diaphragm 60 and may close the first enrichment valve 12 even though the engine is not operating and the fuel pump 18 of the carburetor 10 is not generating any pressure. Since the engine died lean (ran out of fuel) and requires an enriched fuel and air mixture to restart, the engine cannot be restarted without application of sufficient engine crankcase pressure pulses on the fuel metering diaphragm 36 to cause the delivery of an enriched fuel and air mixture to the engine. Accordingly, a carburetor having "only" the first enrichment valve and not the second valve may not be able to overcome this problem. Desirably, in the carburetor 10 even with the first enrichment valve 12 closed, the crankcase pressure pulses which pass through the open second enrichment valve 14 and second path 102 act on the fuel metering diaphragm 36 and will provide a rich enough fuel and air mixture to initially start the hot engine.

Additionally, because the output fuel pump pressure on some small, hand-held, two-stroke engines varies in operation, it is difficult to accurately set the threshold pump pressure upon which the first enrichment valve 12 will close and generally necessitates setting the threshold limit of the first enrichment valve 12 to a lower pump pressure than desired to prevent the valve 12 from opening during modes of low fuel pump pressure operation. This low threshold can cause premature closing of the valve 12 preventing its intended operation during cranking and starting of the engine. This can also exacerbate the problem described above with regard to fuel system pressure closing the first enrichment valve 12 while the hot engine is not operating. However, with the additional crankcase pressure pulse path-(second path 102) in cooperation with the second enrichment valve 14, the threshold limit of the first enrichment valve 12 can be set high enough to prevent premature closing. Undesired opening of the first enrichment valve 12 has no effect on the fuel metering diaphragm 36 in normal operation of the engine, because when the second enrichment valve 14 is in its second position, the pressure pulse passage 72 is closed preventing application of any crankcase pressure pulses to the fuel metering diaphragm. Additionally, the second vent passage 98 is open to the air chamber 40 and any crankcase pressure pulses, which find their way to the air chamber 40 (such as by leakage), are thereby substantially attenuated.

Desirably, the carburetor 10 according to the present invention provides two enrichment valves 12,14 which provide maximum enrichment of the fuel and air mixture to facilitate starting the engine, a lesser fuel enrichment to facilitate warming up the engine after starting, and substantially no fuel enrichment during normal operation of the carburetor 10 and the hot engine. The two enrichment valves 12,14 are preferably separately actuated with each controlling the application of engine crankcase pressure pulses to the fuel metering diaphragm 36 to control the enrichment of the fuel and air mixture delivered to the engine. Notably, the starting procedure for an engine having the carburetor 10 is greatly simplified over that of a three-position choke valve which normally causes the engine to die rich after initial starting, then requires manual adjustment of the valve and restarting of the engine (i.e. additional pulls of the starter rope). Further, the carburetor 10 overcomes two failure modes or problems which may be encountered with a carburetor 10 having only the first enrichment valve 12 and not the second enrichment valve 14.

Second Embodiment

Figure 7:
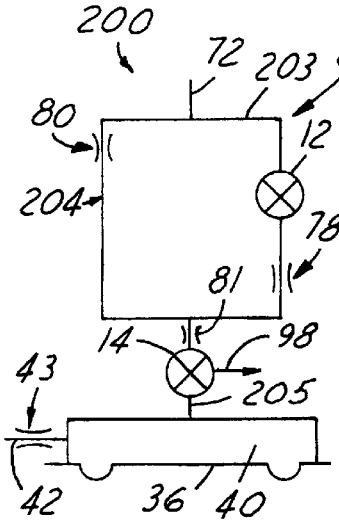
FIG. 7 is a schematic view of a carburetor fuel enrichment circuit illustrating the arrangement of two fuel enrichment valves according to a second embodiment of a carburetor according to the invention.
Figure 8:
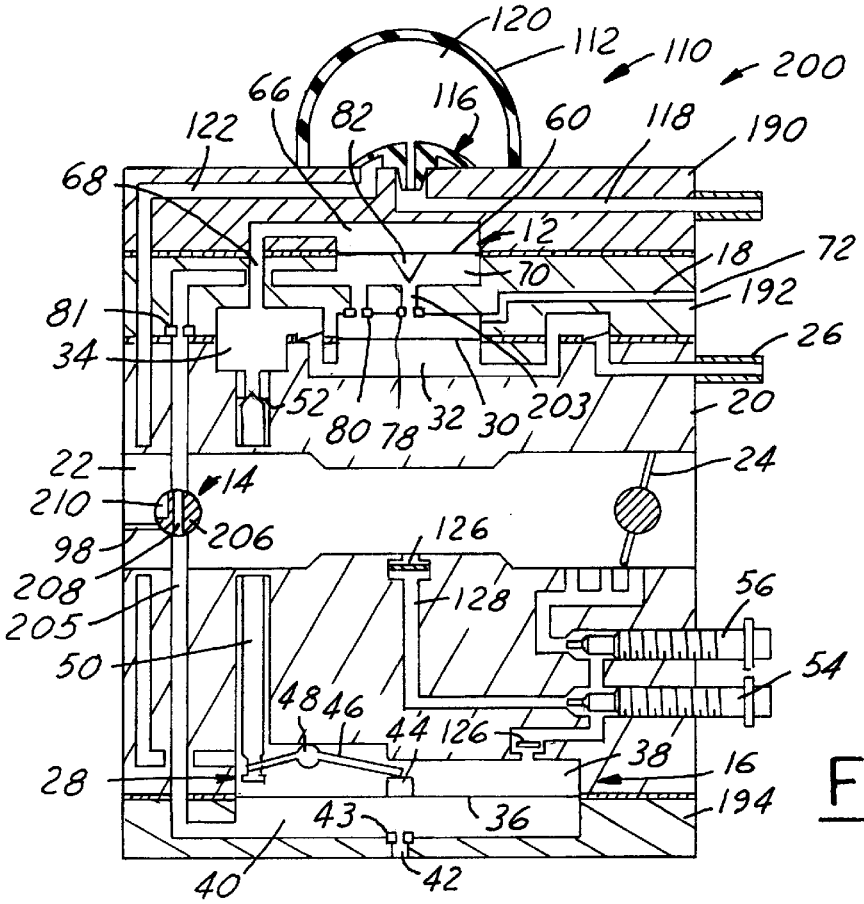
FIG. 8 is a semi-diagrammatic cross sectional view of a carburetor having the fuel enrichment circuit of FIG. 7 with the enrichment valves in a starting or first position.
Figure 9:
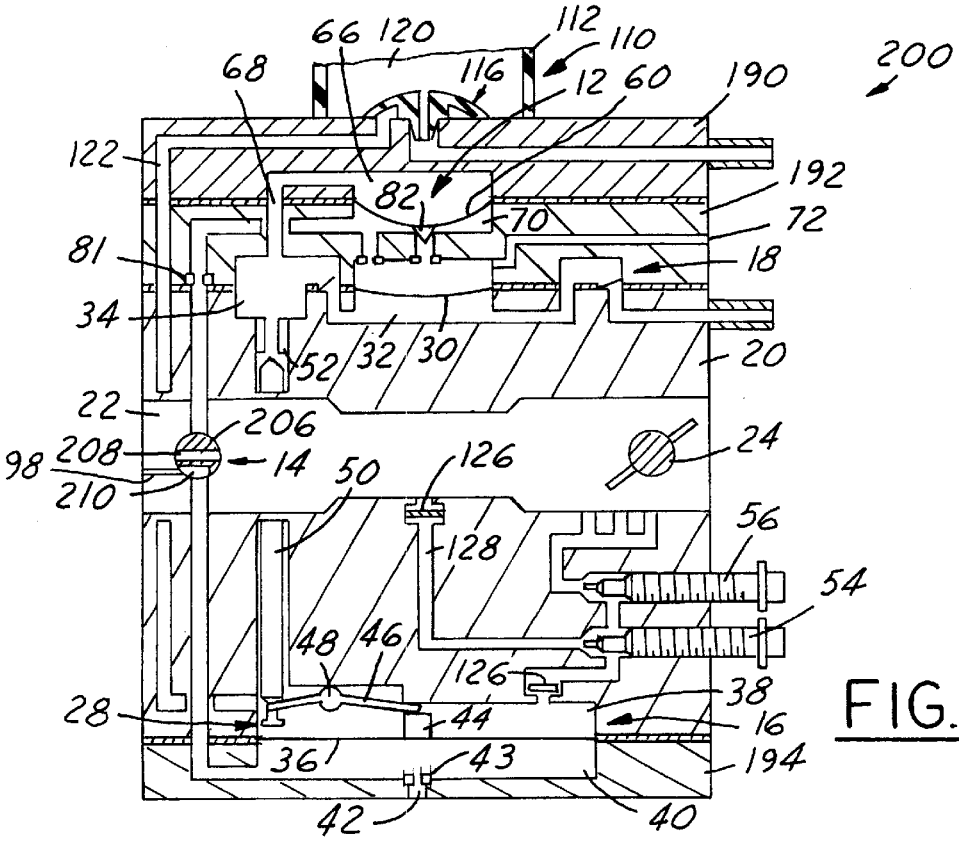
FIG. 9 is a semi-diagrammatic cross sectional view of the carburetor of FIG. 8 with the enrichment valves in a second position.

A second embodiment of a carburetor 200 according to the present invention is shown in FIGS. 7–9. As shown in FIGS. 8 and 9, the control diaphragm 60 and first enrichment valve 12 are disposed between the fuel pump 18 and the purge and primer assembly 110 between a pair of plates 190, 192 carried by the carburetor body 20. The fuel metering diaphragm 36 is disposed between a cover 194 and the carburetor body 20. In other respects the carburetor 200 has parts that are rearranged but which operate in at least substantially the same manner as corresponding parts in carburetor 10. To facilitate review and description of the carburetor 200, the same reference numbers are applied to parts in carburetor 200 as in carburetor 10.

As shown in FIGS. 7–9, a first path 202 communicating crankcase pressure pulses with the air chamber 40 comprises a passage 203, restriction 78, second chamber 70 (FIGS. 8 and 9), the first enrichment valve 12, the second enrichment valve 14 and a passage 205 leading into the air chamber 40. A second path 204 communicating the crankcase pressure pulses with the air chamber 40 comprises passage 72, second chamber 70, restriction 80, passage 205, and the second enrichment valve 14. Another restriction 81 may be provided in path 204 if desired. Accordingly, both paths 202, 204 lead through the second enrichment valve 14 and when it is closed to open the vent 98 to the atmosphere, substantially no crankcase pressure pulses reach the air chamber 40 to prevent such crankcase pressure pulses from materially affecting the displacement of the fuel metering diaphragm 36.

Desirably, as shown in FIGS. 8 and 9, the second enrichment valve 14 may be formed in a shaft 206 extending through the mixing passage 22 upstream of the throttle valve 24. The shaft 206 may or may not have a choke valve plate or head thereon as in a standard choke valve. In any event, the second enrichment valve 14 is defined by a hole 208 through the shaft 206, which is rotatably aligned with the passage 205 to permit crankcase pressure pulses to act on the fuel metering diaphragm 36 and rotated out of alignment with the passage 205 to prevent the application of the pressure pulses on the diaphragm 36. A notch or slot 210 formed in the shaft 206 aligns with and opens the atmospheric vent passage 98 when the second enrichment valve is in its second position. As, shown in FIG. 9, when the shaft 206 is rotated to close the passage 205, the slot 210 aligns with the vent passage 98 to vent the crankcase pressure pulses to the atmosphere through the relatively large flow area vent passage 98. As mentioned previously, with the second enrichment valve 14 in this position substantially no crankcase pressure pulses act on the fuel metering diaphragm 36.

Desirably, providing the second enrichment valve 14 in the shaft 206 whether or not a choke plate is used provides a familiar construction and arrangement for the user of the engine. To start the engine, as with an engine having a conventional choke valve, the shaft 206 is rotated to a starting position (FIG. 8) aligning the hole 208 through the shaft 206 with the remainder of the passage 205 to permit the application of crankcase pressure pulses to the fuel metering diaphragm 36. The first enrichment valve 12 is in its open or starting position (i.e. passage 203 is open to second chamber 70) because the fuel pump 18 is not producing pressure sufficient to close the valve 12.

Upon starting of the engine, a maximum fuel enrichment is attained because both flow paths 202 and 204 are open. After the engine is started, the first enrichment valve 12 will close when the fuel pump 18 provides a sufficient pressure signal to the valve 12. With the first enrichment valve 12 closed, passage 203 and hence the first path 202 is closed and only the crankcase pressure pulses flowing through the second path 204 will act on the fuel metering diaphragm 36. This provides a lesser than maximum fuel enrichment, which facilitates warming up the engine. As shown in FIG. 9, when the engine is warmed up the shaft 206 may be rotated to its second position closing the passage 205 and opening the vent passage 98 to at least substantially prevent the application of crankcase pressure pulses on the fuel metering diaphragm 36 thereby enabling essentially normal operation of the carburetor 200 and engine. Preferably, upon actuation of the throttle valve 24 from its starting position shown in FIG. 8 toward its wide open position the shaft 206 will automatically rotate to its second position through a linkage or other mechanism, such as a return spring, responsive to such movement of the throttle valve 24.

Third Embodiment

Figure 10:
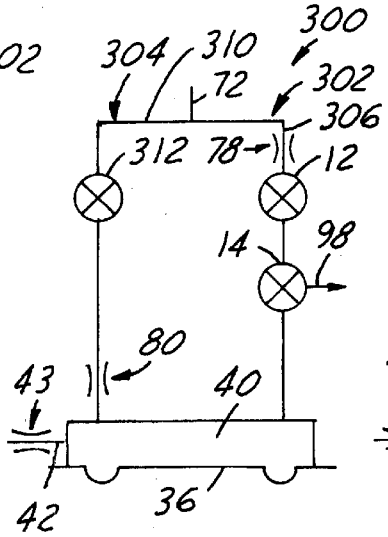
FIG. 10 is a schematic view of a fuel enrichment circuit of a carburetor according to a third embodiment of the invention and having three enrichment valves.
Figure 11:
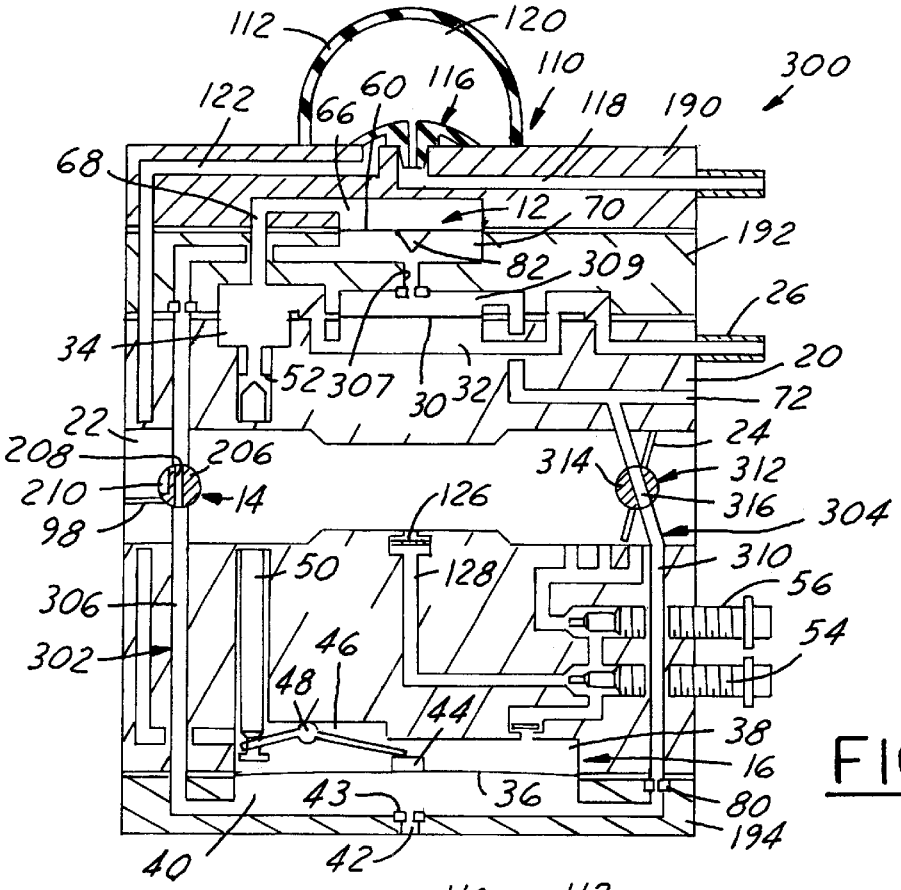
FIG. 11 is a semi-diagrammatic cross sectional view of a carburetor having the fuel enrichment circuit of FIG. 10 showing the valves in a starting or first position.
Figure 12:
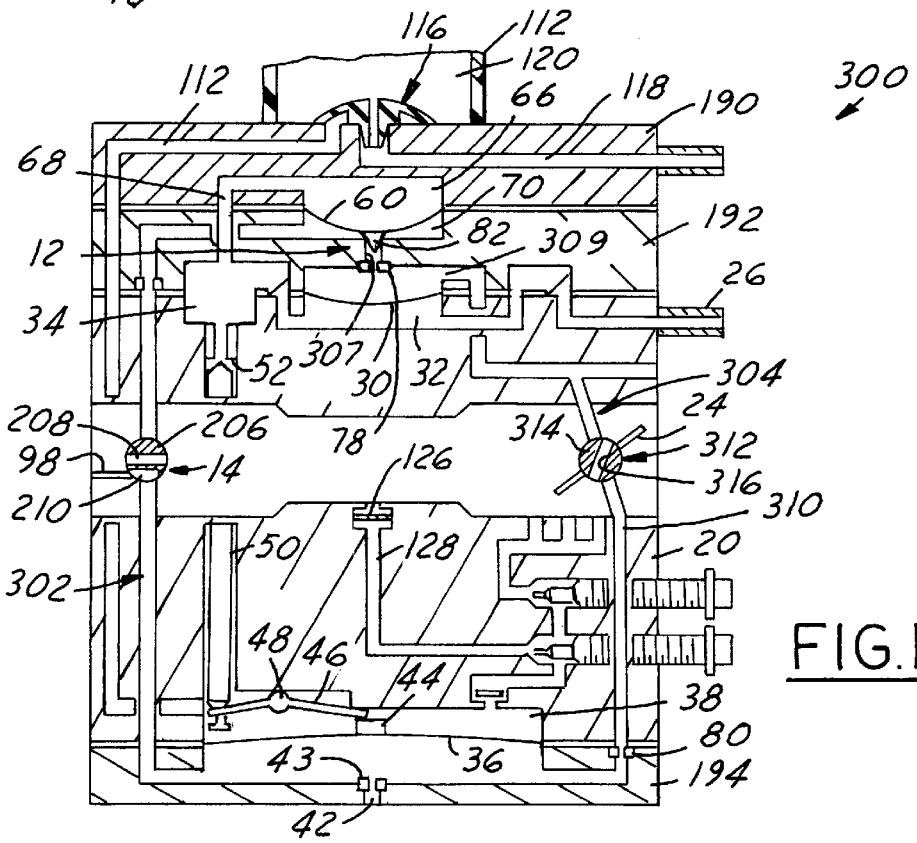
FIG. 12 is a semi-diagrammatic cross sectional view of the carburetor of FIG. 10 with the valves in a second position.
Figure 14:
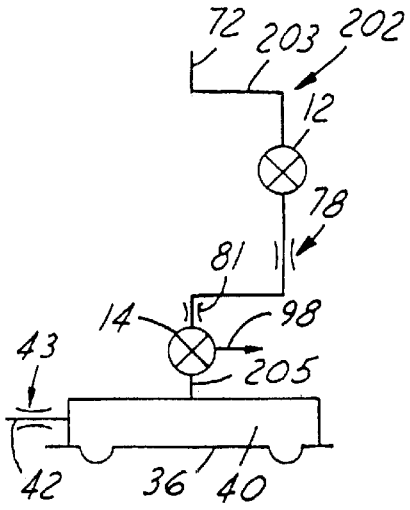
FIG. 14 is a schematic view of a fuel enrichment circuit of a carburetor according to a fifth embodiment of the invention.

A third embodiment of a carburetor 300 according to the present invention is shown in FIGS. 10–12. As in the previous embodiment carburetors 10, 200, the carburetor 300 has two flow paths 302, 304 through which crankcase pressure pulses are communicated with the air chamber 40. A first flow path 302 communicates the crankcase pressure pulse passage 72 with the air chamber 40 through a passage 306, restriction 78, the first enrichment valve 12, and the second enrichment valve 14. The passage 306 includes a bore 307 communicating a pulse chamber 309 of fuel pump 18 with the second chamber 70. Bore 307 is selectively closed by the first enrichment valve 12 in response to a fuel pump pressure signal as discussed in the previous embodiment carburetors 10, 200. The second path 304 communicates the crankcase pressure pulse passage 72 with the air chamber 40 through a passage 310, a third enrichment valve 312 and restriction 80.

Desirably, the second enrichment valve 14 is formed through a shaft 206 as described with the respect to the second enrichment valve 14 in the second embodiment carburetor 200. The third enrichment valve 312 is preferably formed through a shaft 314 of the throttle valve 24 in a similar manner. Rotation of the throttle valve 24 selectively aligns a hole 316 through the throttle shaft 314 with the passage 310 leading to the air chamber 40. Desirably, as shown in FIG. 11, the hole 316 through the throttle valve shaft 314 aligns with the passage 310 when the throttle valve 24 is in its starting position so that the passage 310 is open when the throttle valve 24 is in its starting position.

To start an engine having carburetor 300, the shaft 206 is rotated to its first position (FIG. 11) aligning the hole 208 therethrough with the passage 306 and closing the atmospheric vent passage 98. The first enrichment valve 12 is open because the fuel pump 18 is not producing pressure sufficient to close it. The throttle valve shaft 314 is rotated to its starting position such that its hole 316 is aligned with its corresponding passage 310. Preferably, rotation of the shaft 206 to its first position automatically moves the throttle valve 24 to its starting position, such as through a linkage, cam or other connection between the shaft 206 and throttle valve 24. This permits both the second and third valves 14, 312 to be set to their position suitable for starting of the engine by rotation of only the shaft 206. As shown in FIG. 11 with the enrichment valves 12, 14, 312 so constructed and arranged, both paths 302 304 are open when the engine is initially started to provide a maximum enrichment of the fuel and air mixture delivered to the engine.

Upon starting of the engine, the fuel pump 18 produces pressure sufficient to close the first enrichment valve 12 and hence, bore 307 thereby preventing the application of crankcase pressure pulses through the first path 302 to the air chamber 40. The throttle valve 24 and hence, the third enrichment valve 312 remains in its starting position to provide crankcase pressure pulses through the second path 304 to the air chamber 40 and acting on the fuel metering chamber 36 to provide a less than maximum but still somewhat enriched fuel and air mixture to the engine to facilitate warming it up.

From here, the operator of the engine has a couple of options. First, the shaft 206 may be rotated to its second position (as shown in FIG. 12) independently of any movement of the throttle valve 24 to open the large flow area atmospheric vent passage 98 and thereby dilute the crankcase pressure pulse signal in the air chamber 40 and acting on the fuel metering diaphragm 36. Accordingly, a further reduction of the enrichment of the fuel and air mixture is obtained with the third enrichment valve 312 open and the second enrichment valve 14 in its second position opening the vent passage 98. To eliminate or at least substantially prevent application of any crankcase pressure pulses to the air chamber 40 and fuel metering diaphragm 36, the throttle valve shaft 314 may be rotated to move the throttle valve 24 towards its wide open throttle position rotating the hole 316 through the throttle valve shaft 314 out of alignment with its passage 310 thereby closing the second path 304. Now, both paths 302 and 304 are closed and the large flow area vent passage 98 is open permitting essentially normal operation of the carburetor and engine. As an alternative, rather than manually moving the second enrichment valve 14 (i.e. manually rotating shaft 206) to its second position, the throttle valve shaft 314 may be linked to the shaft 206 or shaft 206 may be biased to its second position such that actuation of the throttle valve 24 from its starting position towards wide open throttle automatically rotates or permits the shaft 206 to rotate to its second position to close the second path 304 and open the vent passage 98 without requiring the operator to manually or directly rotate the shaft 206.

Accordingly, the carburetor 300 provides increased flexibility of the starting and warming up of the engine. For example, a less experienced operator may close the second path 304 and open the vent passage 98 simply by actuating the throttle valve 24 from its starting position towards wide open throttle. A more experienced operator may manually rotate the shaft 206 independently of the throttle valve shaft 314 to control the venting of the air chamber 40 and thereby the effect of the crankcase pressure pulses flowing through the second path 304. Accordingly, a more experienced operator may control the application of crankcase pressure pulses in response to operation of the engine by opening path 304 to avoid the engine dying lean and closing path 304 when the engine in sufficiently warmed up.

Fourth Embodiment

Figure 13:
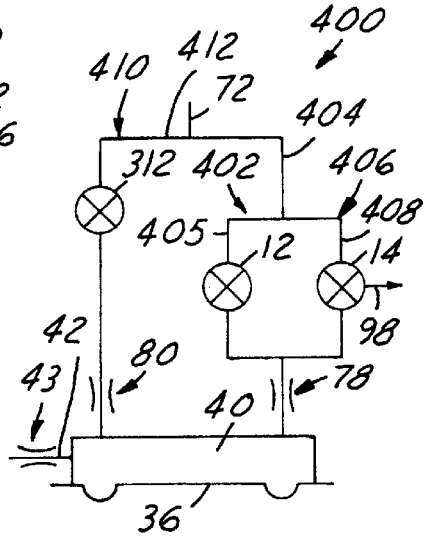
FIG. 13 is a schematic view of a fuel enrichment circuit of a carburetor according to a fourth embodiment of the invention.

As shown in FIG. 13, a fourth embodiment of a carburetor 400 is constructed essentially the same as the third embodiment carburetor 300 except that the first enrichment valve 12 and second enrichment valve 14 are disposed in a parallel circuit rather than in series as in the third embodiment carburetor 300. With this arrangement, three paths are provided for communicating the crankcase pressure pulse passage 72 with the air chamber 40. A first flow path 402 comprises a passage 404, another passage 405, the first enrichment valve 12 and the restriction 78. A second flow path 406 comprises passage 404, another passage 408 the second enrichment valve 14 and the restriction 78. A third flow path 410 comprises passage 412, the third enrichment valve 312 and restriction 80. Accordingly, even when the first enrichment valve 12 closes after starting of the engine and sufficient pressure of the fuel pump 18 is generated, crankcase pressure pulses may reach the air chamber 40 through both the second and third paths 406 and 410, respectively. These paths 406, 410 may be closed by the second and third enrichment valves 14, 312, respectively, independently of each other or dependent upon each other such as through a linkage or other actuating mechanism.

After the engine is started and the first enrichment valve 12 is closed, the second and third enrichment valves 14, 312 and second and third paths 406, 410 remain open. Desirably, rotation of the throttle valve 24 from its starting position towards its wide open throttle position closes the third enrichment valve 312 and preferably also moves or permits the second enrichment valve 14 to move to its second position to close the second path 406 and open the vent passage 98. The carburetor 400 and engine are now set for essentially normal operation.

Alternatively, after the engine is warmed up the shaft 206 may be rotated to move the second enrichment valve 14 to its second position without moving the throttle valve 24 off its starting position, to close the second path 406 and leave the third path 410 open providing crankcase pressure pulses to the air chamber 40 through only the third path 410. As still a further alternative, the throttle valve shaft 314 may be rotated, such as to further open the throttle valve 24 and "rev" the engine and facilitate warming it up, which closes the third path 410 without moving the second enrichment valve 14 to its second position. Because the second enrichment valve 14 remains in its first position even if the throttle valve 24 is moved toward wide open throttle, the operator can "rev" the engine without terminating the application of crankcase pressure pulses to the fuel metering diaphragm 36 through the second path 406. When the engine has fully warmed up, the shaft 206 may be rotated to move the second enrichment valve 14 to its second position closing the second path 406 and opening the vent passage 98 to permit normal operation of the carburetor 400 and engine. Accordingly, the fourth embodiment carburetor 400 provides still further flexibility in starting and warming up the engine.

Fifth Embodiment

A fifth embodiment of a carburetor 500 according to the present invention is shown in FIGS. 14–17. The carburetor 500 has parts that are arranged substantially the same as corresponding parts in carburetor 200. To facilitate review and description of the carburetor 500, the same reference numbers are applied to parts in carburetor 500 that are the same or essentially so in carburetor 200.

Figure 15:
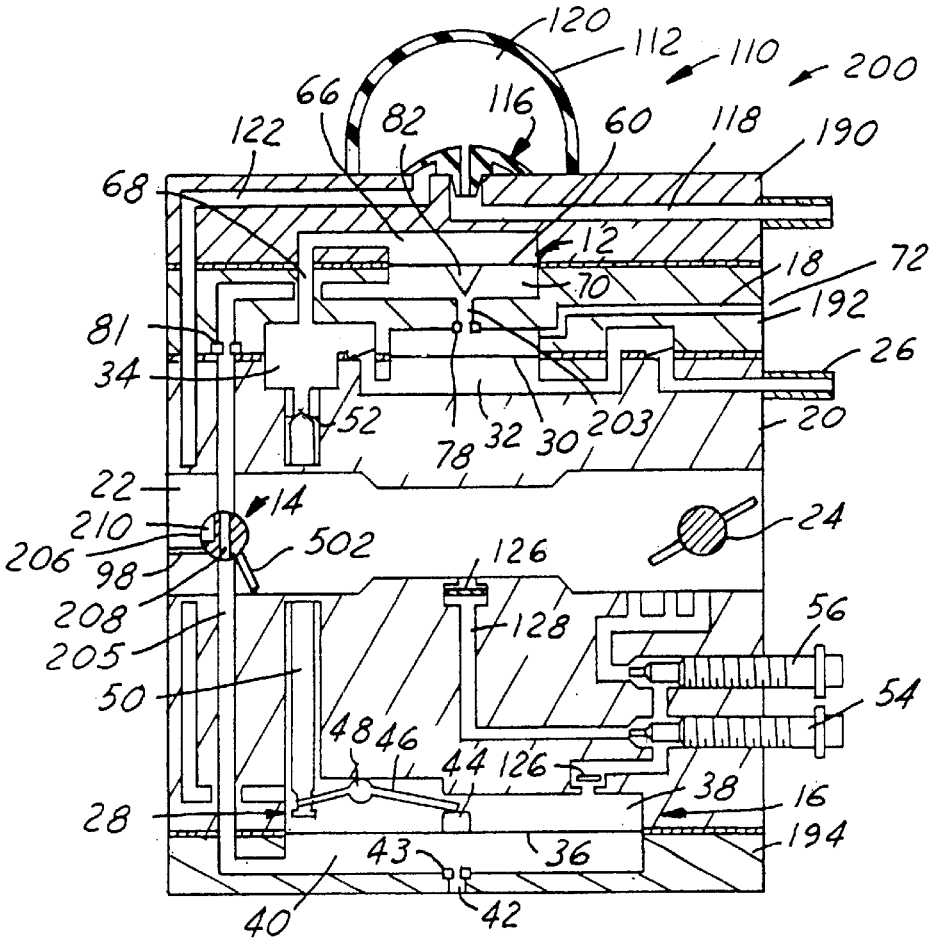
FIG. 15 is a semi-diagrammatic cross sectional view of a carburetor having the fuel enrichment circuit of FIG. 14 with the enrichment valves in a starting or first position.
Figure 16:
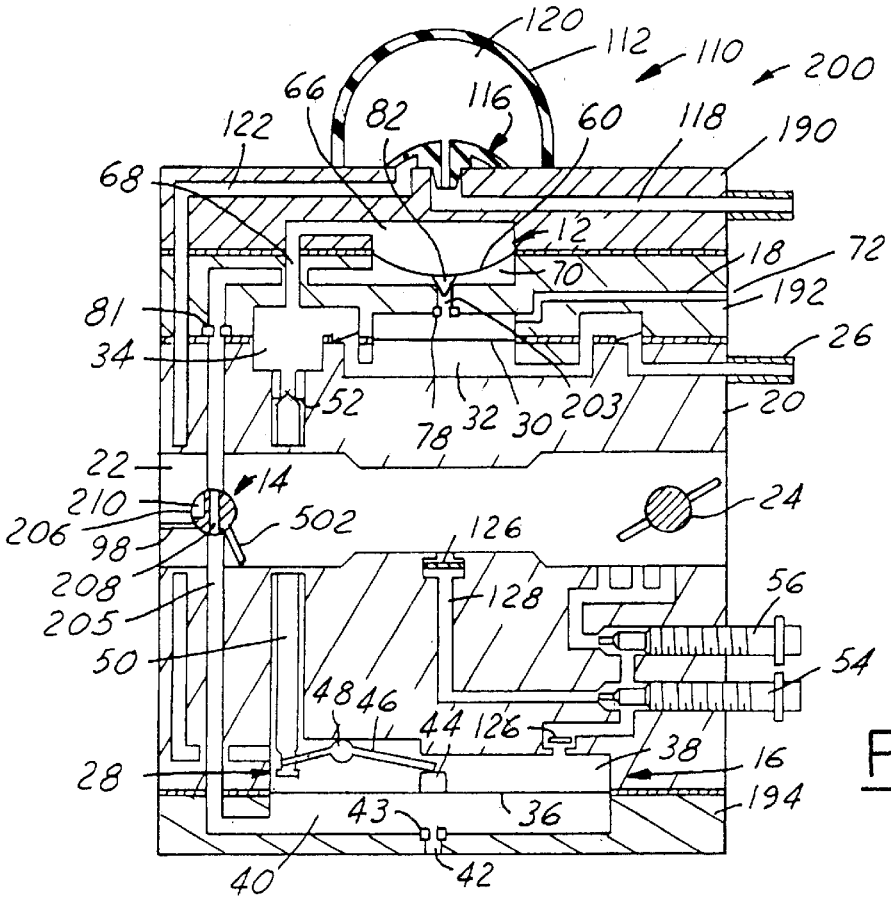
FIG. 16 is a semi-diagrammatic cross sectional view of a carburetor having the fuel enrichment circuit of FIG. 14 with the enrichment valves in a warming-up or intermediate position.
Figure 17:
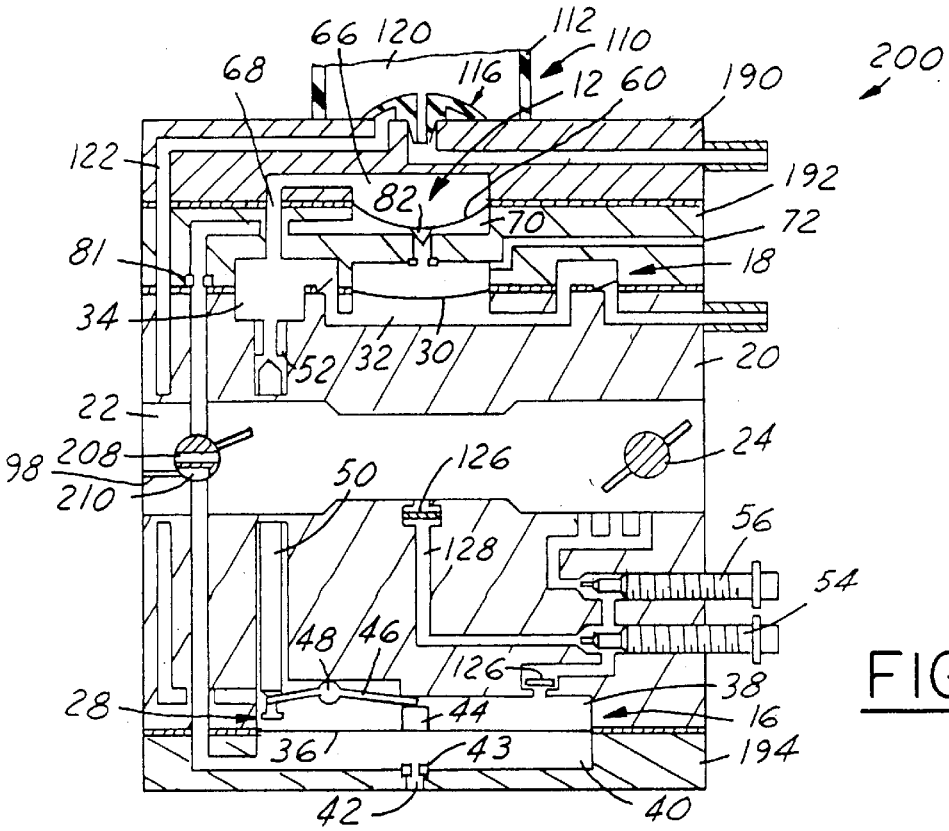
FIG. 17 is a semi-diagrammatic cross sectional view of a carburetor having the fuel enrichment circuit of FIG. 14 with the enrichment valves in a normal running or second position.

As shown in FIGS. 14–17, a first path 202 communicating crankcase pressure pulses with the air chamber 40 comprises a passage 203, restriction 78, second chamber 70 (FIGS. 15–17), the first enrichment valve 12, the second enrichment valve 14 and a passage 205 leading into the air chamber 40. Another restriction 81 may be provided in path 205 if desired. Accordingly, path 202 leads through the second enrichment valve 14 and when the second enrichment valve 14 closes path 202, vent 98 is open to the atmosphere (as shown in FIG. 17) and substantially no crankcase pressure pulses reach the air chamber 40. This prevents crankcase pressure pulses from materially affecting the displacement of the fuel metering diaphragm 36.

Desirably, as shown in FIGS. 15–17, the second enrichment valve 14 may have a shaft 206 extending through the mixing passage 22 upstream of the throttle valve 24. The shaft 206 has a choke valve plate 502 or head thereon that is rotatable relative to the mixing passage 22 to control air flow therethrough. Desirably, although not necessarily, the plate 502 is sized smaller than the mixing passage so that when the plate is disposed generally perpendicular to the mixing passage 22 (as shown in FIGS. 15 and 16), air flow is only partially restricted, not prevented entirely. When the choke plate 502 restricts air flow through the mixing passage 22, an at least somewhat richer than normal fuel and air mixture is delivered to the engine. Hence, the mixing passage 22 comprises a second fluid flow path that can be controlled to control fuel delivery to the engine.

The second enrichment valve 14 is rotatable between a first position (as shown in FIG. 17) and a second position (as shown in FIGS. 15 and 16). To move the valve 14, the shaft 206 is rotated between corresponding first and second positions. As shown in FIG. 17, when the shaft 206 is in its first position, its hole 208 is not aligned with passage 205, the vent 98 is communicated with the air chamber 40, and the choke plate 502 of the second enrichment valve 14 is in an open position generally parallel to fluid flow through the mixing passage 22 permitting a substantially unrestricted fluid flow thereby and through the mixing passage 22. As shown in FIGS. 15 and 16, when the shaft 206 is in its second position, its hole 208 is aligned with passage 205, the vent 98 is not communicated with the air chamber 40 and the choke plate 502 of the second enrichment valve 14 is in a closed position generally perpendicular to the fluid flow through the mixing passage 22 and at least partially restricting fluid flow through the mixing passage 22.

As shown in FIG. 15, prior to starting the engine the shaft 206 is rotated to move the second enrichment valve 14 its to its second position. The first enrichment valve 12 is open as described in preceding embodiments. Upon starting of the engine, a maximum fuel enrichment is attained because both flow path 202 is open providing pressure pulses to the air chamber 40 and the choke plate 502 is closed partially restricting air flow through the mixing passage 22. After the engine is started, the first enrichment valve 12 will close when the fuel pump 18 provides a sufficient pressure signal to the valve 12. As shown in FIG. 16, with the first enrichment valve 12 closed, passage 203 and hence the first path 202 is closed, however the second enrichment valve remains in its second position with choke plate 502 restricting air flow through the mixing passage 22. This provides a less than maximum, although still somewhat enriched fuel and air mixture to the engine to facilitate warming-up the engine.

As shown in FIG. 17, when the engine is warmed-up, the second enrichment valve 14 and shaft 206 may be rotated to their first position wherein hole 208 is not aligned with passage 205 and the vent passage 98 is communicated with the air chamber 40 to at least substantially prevent the application of crankcase pressure pulses on the fuel metering diaphragm 36. This also moves the choke plate 502 to its open position permitting a substantially unrestricted fluid flow through the mixing passage 22 so that the carburetor 500 delivers a desired ratio of fuel to air in a mixture for essentially normal operation of the engine. Preferably, upon actuation of the throttle valve 24 from its starting position shown in FIG. 15 toward its wide open position, the choke plate 502 will automatically be rotated to its first position by a linkage or other mechanism, such as a return spring, responsive to such movement of the throttle valve 24.

In each embodiment of the carburetor 10, 200, 300, 400, 500 at least two fluid flow paths are provided that allow for the selective application of an enriched fuel to air mixture ratio to facilitate operation of an engine. At least one flow path provides for the application of crankcase pressure pulses to a fuel metering diaphragm 36 wherein the crankcase pressure pulses applied to the fuel metering diaphragm 36 provide an enriched fuel and air mixture delivered to the engine to facilitate starting and warming it up. After the engine has started, at least one of the paths is closed, preferable automatically, to reduce the enrichment of the fuel and air mixture while still providing some enrichment to facilitate warming up the engine. After the engine is sufficiently warmed-up, flow through the remaining path or paths is controlled to further reduce the enrichment of the fuel to air mixture and preferably, a large flow area atmospheric vent is open to essentially eliminate or prevent the crankcase pressure pulses from acting on or influencing the fuel metering diaphragm to permit normal operation of the carburetor and engine. Desirably, the carburetor facilitates starting and warming-up of the engine for a novice operator and may provide increased control of the starting and warming up procedure for a more experienced operator, if desired.

The above description is intended to illustrate a few practical embodiments of the invention and is not intended to limit the invention which is defined by the claims which follow. Various modifications within the spirit and scope of the invention will be readily apparent to those skilled in the art. For example, in carburetor 200 in place of shaft 206, the second enrichment valve 14 may be formed in the throttle valve shaft as in shaft 314 of carburetor 300. Of course, passage 205 would be eliminated in favor of passage 310 of carburetor 300. Further, a one way check valve may be provided in any or all of the flow paths in each embodiment carburetor (as in carburetor 10 with check valve 103) to permit only the positive pressure portion of the crankcase pressure pulses therethrough to increase the intensity of the pressure signal. Still other modifications and arrangements within the spirit and scope of the invention are possible.

What is claimed is:

1. A carburetor for providing a fuel and air mixture to an engine, comprising:

a body;

a fuel metering assembly having a fuel metering diaphragm carried by the body, having two generally opposed sides and defining in part an air chamber on one side and a fuel chamber on its other side;

a first flow path communicating with the air chamber and constructed to be in communication with a crankcase chamber of an engine;

a second flow path in the body at least partially independent of the first flow path;

a first enrichment valve disposed in communication with the first flow path and movable between a first position permitting fluid flow from the first flow path therethrough and into the air chamber to cause an enriched fuel and air mixture to be delivered to the engine in response to such fluid flow and a second position substantially preventing fluid flow from the first flow path therethrough and into the air chamber; and a second enrichment valve disposed in communication with at least the second flow path and movable between first and second positions to affect fluid flow through the second flow path and thereby selectively enrich the fuel and air mixture delivered to the engine.

2. The carburetor of claim 1 which also comprises a vent valve and a vent passage communicating with the air chamber at one end, with the atmosphere at the other end and with the vent valve so that the vent valve selectively permits communication of the air chamber with the atmosphere through the vent passage.

3. The carburetor of claim 1 wherein the first and second enrichment valves are movable independently of each other.

4. The carburetor of claim 1 which also comprises:

a fuel pump carried by the body and constructed to draw fuel from a supply tank and deliver fuel under pressure to the fuel chamber; and a pump passage communicating with the fuel pump and with the first enrichment valve to move the first enrichment valve from its first position toward its second position when the pressure at the fuel pump is above a threshold pressure.

5. The carburetor of claim 4 which also comprises a control diaphragm carried by the body, having a pair of opposed sides, defining in part a first chamber on one side in communication with the pump passage and movable in response to pressure in the first chamber above a threshold pressure to actuate the first enrichment valve.

6. The carburetor of claim 5 wherein the first enrichment valve is carried by the control diaphragm.

7. The carburetor of claim 5 wherein the control diaphragm also defines in part a second chamber spaced from the first chamber and communicated with the air chamber through a pair of passages which each define a portion of the first flow path, the first enrichment valve closes one of said pair of passages to prevent the application of engine crankcase pressure pulses to the air chamber through the first flow path while permitting engine crankcase pressure pulses to be transmitted to the air chamber through the second flow path if the second valve is in its first position.

8. The carburetor of claim 5 wherein the control diaphragm also defines in part a second chamber spaced from the first chamber and communicated with the air chamber through a passage which defines a portion of the first flow path, the first enrichment valve closes the passage to prevent the application of engine crankcase pressure pulses to the air chamber through the first flow path.

9. The carburetor of claim 1 which also comprises a throttle valve movable between idle, starting and wide open positions to control air flow through the carburetor and operably associated with the second enrichment valve so that the second enrichment valve moves from its first position to its second position when the throttle valve moves from its starting position toward its wide open position.

10. The carburetor of claim 9 wherein the throttle valve has a shaft and a hole through the shaft defines at least in part the second enrichment valve.

11. The carburetor of claim 1 which also comprises a vent passage communicating the air chamber with the atmosphere and being of sufficient size to maintain the pressure in the air chamber substantially at atmospheric pressure when open even when engine crankcase pressure pulses are communicated to the air chamber and the second enrichment valve closes the vent opening when in its first position so that the engine crankcase pressure pulses acting on the fuel metering diaphragm through at least the second flow path are not vented to the atmosphere through the vent passage.

12. The carburetor of claim 1 wherein the first flow path has at least one restriction which limits the fluid flow therethrough to control the magnitude of crankcase pressure pulses applied to the air chamber through the first flow path.

13. The carburetor of claim 1 wherein the second flow path has at least one restriction which limits the fluid flow therethrough to control the magnitude of crankcase pressure pulses applied to the air chamber through the second flow path.

14. The carburetor of claim 1 which also comprises a pressure pulse passage formed at least in part in the body and constructed and arranged to communicate the engine crankcase chamber with both the first and second flow paths, and wherein the second enrichment valve closes the pressure pulse passage when in its second position to prevent the application of engine crankcase pressure pulses to the air chamber through the first and second flow paths.

15. The carburetor of claim 1 wherein the second enrichment valve comprises a shaft, and a hole formed through the shaft rotatable into and out of alignment with the second flow path.

16. The carburetor of claim 15 which also comprises a vent valve and a vent passage communicating the air chamber with the atmosphere and selectively closed by the vent valve, wherein the vent valve comprises a second hole through the shaft selectively rotated into and out of alignment with the vent passage.

17. The carburetor of claim 16 wherein the hole of the second enrichment valve and the second hole are offset from each other so that when the hole of the second enrichment valve is aligned with the second flow path the second hole is not aligned with the vent passage.

18. The carburetor of claim 15 which also comprises a mixing passage formed in the body and wherein the shaft extends through the mixing passage.

19. The carburetor of claim 1 which also comprises a throttle valve movable between idle, starting and wide open positions to control air flow through the carburetor and operably associated with the second enrichment valve so that the second enrichment valve moves from its second position to its first position when the throttle valve moves from its starting position toward its wide open position.

20. The carburetor of claim 1 wherein the second flow path comprises a mixing passage for air and fuel.

21. The carburetor of claim 20 wherein the second enrichment valve is a choke valve.

22. The carburetor of claim 21 wherein the choke valve is generally semicircular in shape, whereby when the choke valve is in the first position, it permits at least a partial flow of fluid thereby.

23. The carburetor of claim 1 which also comprises a third enrichment valve disposed in communication with at least one of the first and second flow paths and movable between first and second positions to selectively permit fluid flow therethrough and a vent valve associated with the third enrichment valve and selectively communicating the air chamber with the atmosphere so that when the third enrichment valve is in its position preventing fluid flow therethrough the vent valve communicates the air chamber with the atmosphere.

24. The carburetor of claim 23 wherein the first enrichment valve and third enrichment valve are disposed in series.

25. The carburetor of claim 1 which also comprises:

a third flow path communicating with the air chamber and constructed to be in communication with a crankcase chamber of an engine; and a third enrichment valve disposed in communication with the third flow path and movable between a first position permitting fluid flow therethrough and to the air chamber and a second position preventing fluid flow from the third flow path to the air chamber.

26. The carburetor of claim 25 wherein the first enrichment valve and the third enrichment valve are disposed in parallel.

27. The carburetor of claim 1 which also comprises at least one check valve disposed in communication with at least one of the first and second flow paths to permit only the positive pressure portion of the crankcase pressure pulses therethrough.

28. A carburetor for providing a fuel and air mixture to an engine, comprising:

a body;

a fuel metering assembly having a fuel metering diaphragm carried by the body, having two generally opposed sides and defining in part an air chamber on one side and a fuel chamber on its other side;

a first flow path communicating with the air chamber and constructed to be in communication with a crankcase chamber of an engine;

a first enrichment valve disposed in communication with the first flow path and movable between a first position permitting fluid flow from the first flow path therethrough and into the air chamber and a second position substantially preventing fluid flow from the first flow path therethrough and into the air chamber; and a second enrichment valve carried by the body and movable between a first position permitting fluid flow thereby and a second position at least partially restricting fluid flow, whereby, the first enrichment valve controls the application of crankcase pressure pulses through the first flow path to the air chamber and fuel metering diaphragm at least partially regulating the fuel to air mixture within the body and the second enrichment valve at least partially regulates the fuel to air mixture within the body.

29. The carburetor of claim 28 wherein the first and second enrichment valves are movable independently of each other.

30. The carburetor of claim 28 which also comprises a throttle valve movable between idle, starting and wide open positions to control air flow through the carburetor and operably associated with the second enrichment valve so that the second enrichment valve moves from its second position to its first position when the throttle valve moves from its starting position toward its wide open position.

31. The carburetor of claim 28 wherein the second flow path comprises a mixing passage for air and fuel.

32. The carburetor of claim 31 wherein the second enrichment valve is a choke valve.

33. The carburetor of claim 32 wherein the choke valve is generally semicircular in shape, whereby when the choke valve is in the first position, it permits at least a partial flow of fluid thereby.

* * * * *

UNITED STATES PATENT AND TRADEMARK OFFICE

CERTIFICATE OF CORRECTION

PATENT NO. : 6,622,992 B2
DATED : September 23, 2003
INVENTOR(S) : John C. Woody It is certified that error appears in the above-identified patent and that said Letters Patent is hereby corrected as shown below:

Column 15,
Line 3, delete "vent opening" and insert -- vent passage --.

Signed and Sealed this

Twenty-fifth Day of November, 2003

JAMES E. ROGAN
*Director of the United States Patent and Trademark Office*